United States Patent [19]

Mader

[11] Patent Number: 4,588,044

[45] Date of Patent: May 13, 1986

[54] HAWAII TRAPEZE SPREADER BAR

[75] Inventor: Klaus Mader, Waging, Fed. Rep. of Germany

[73] Assignee: Reinhard Mader, Petting, Fed. Rep. of Germany; a part interest

[21] Appl. No.: 637,135

[22] Filed: Sep. 27, 1984

Related U.S. Application Data

[63] Continuation of Ser. No. 427,932, Sep. 29, 1982, Pat. No. 4,474,261.

[30] Foreign Application Priority Data

Oct. 13, 1981 [DE] Fed. Rep. of Germany ..... 3140668

[51] Int. Cl.[4] ..... B63H 9/10

[52] U.S. Cl. ..... 182/3; 114/39

[58] Field of Search ..... 182/3–5; 114/39.2; 441/108, 84; 119/96, 101

[56] References Cited

U.S. PATENT DOCUMENTS

| | | | |
|---|---|---|---|
| 2,581,772 | 1/1952 | Rose | 182/4 |
| 3,300,247 | 1/1967 | Marks | 297/468 |
| 4,303,041 | 12/1981 | Thompson | 182/7 |
| 4,445,866 | 5/1984 | Cillieres | 119/96 |

FOREIGN PATENT DOCUMENTS

| | | | |
|---|---|---|---|
| 141893 | 1/1935 | Austria | 182/3 |
| 2916643 | 11/1980 | Fed. Rep. of Germany | 114/39.2 |

*Primary Examiner*—Reinaldo P. Machado
*Assistant Examiner*—Alvin Chin-Shue
*Attorney, Agent, or Firm*—Hauke and Patalidis

[57] ABSTRACT

A support device including a hook for suspending a person wearing the support device on a rope. The person may be fastened into the support device by means of a transverse belt attached to the upper torso, with the transverse belt extending through slots provided in the support device. The support device includes a spreader bar whose length corresponds approximately to the width of a human chest, with the rope-retaining hook being attached to the spreader bar at a point midway between the ends thereof. The spreader bar is made of a substantially rigid material and serves, when the belt is applied to the person, to support said person in the area defining the width of the chest. Accordingly, for all practical purposes, no lateral forces are transmitted to the person by the pulling of the rope and, consequently, no discomfort through chest constriction is caused by the support device.

9 Claims, 3 Drawing Figures

HAWAII TRAPEZE SPREADER BAR

This is a continuation of application Ser. No. 427,932, filed Sept. 29, 1982, now U.S. Pat. No. 4,474,261.

BACKGROUND OF THE INVENTION

The invention relates to a support device provided with a hook for suspending a person on a rope, with the person being supported at his upper torso by means of a transversely disposed belt, and the belt being adapted for attachment to the support device. The support device has particular utility as a Hawaii-type trapeze belting system used for wind surfing.

In the sport of wind-surfing it is known to control the wind pressure being applied to the sail by holding the sail with the hand. In addition, belt-type assist devices are known which are made so as to free the arms of the load during surfing, and which are suitable for use under more extreme wind conditions. Belt-type assist devices of this nature are usually comprised of a transversely disposed belt attached around the upper torso of the surfer, and a cushioned back portion. In the general area of the surfer's diaphragm, a square hook plate is attached to the fastened transverse belt, and the rope is secured to the hook of the hook plate. This type of belting is basically known as a "Hawaii Trapeze Belting System" (see "Wind Surfing Magazine", Aug. 8, 1981, p. 28 to 34).

The conventional Hawaii trapeze belt provided with a hook plate has the disadvantage that a considerable amount of pressure is being applied to the person during surfing. Under certain conditions, such as may exist with extremely heavy winds or gusts, the belt not only may become very uncomfortable to the person wearing it, but may also cause pain or even difficulty in breathing. These problems are experienced because of the poorly cushioned short back portion of the support device and also because of insufficient pressure distribution in the area of contact between the flexible transverse belt and the chest of the belt-wearing person. Therefore, tugging of a rope, in combination with a medially disposed hooked draft gear affixed to the rope creates lateral forces generated to the right and the left of the surfer in the area of the pleura.

In an effort to eliminate these shortcomings, a number of manufacturers have attempted to improve these type of belt systems. Some of the devices known in the art consist of various types of body bandages provided with extended, heavily cushioned shell-type back portions, and multi-belt arrangements including, for instance, dual shoulder belts and additional transverse, diagonal and/or crotch belts which are expected to improve the pressure distribution on the body. Furthermore, lateral reinforcement rods have been used as inserts in body bandages.

One disadvantage in all of the better types of Hawaii trapeze belt systems is the fact that in order to make improvements in terms of comfort, compromises have to be made in other areas, including the areas of freedom of movement, ease of handling, ease of discarding as well as volume of water absorption, good fit and price.

SUMMARY OF THE INVENTION

It is an object of the present invention to provide a support system incorporating a hook member which support system is structurally simple and does not cause lateral forces to be transmitted to the chest of the person wearing the system. This objective of the invention is achieved by a substantially rigid spreader bar supporting a fastened transverse belt across one of its lateral surfaces. The spreader bar corresponds approximately to the width of a person's chest and has a hook medially attached to it.

More particularly, the hook and the hook plate may be made of a single piece, and the hook plate is attached to the spreader bar. The hook plate may be detachably fastened to the spreader bar by means of recessed flat-head bolts, if desired.

For a particularly solid arrangement, the hook plate may also be permanently fixed to the spreader bar by means of tubular rivets of the flat-head type.

Suitable slots may be provided between the hook plate and the spreader bar for insertion of a transverse belt that is trained around the upper torso of a surfer. In addition, the spreader bar is preferably provided over its entire length with an elongated guide means or track to prevent lateral displacement of the belt when it is stretched and in position over the spreader bar. As shown hereafter, the guide means is in the form of a recess integrally formed on the spreader bar. Slots are also provided in the end portions of the spreader bar, such that the belt is fed in the area of the sides of the upper torso through said slots and extends into the back portion of the surfer.

Furthermore, the spreader bar may be provided with additional slots, especially upper and/or lower slots for accommodating a shoulder, diagonal and/or crotch belt.

According to another advantageous feature of the invention, the spreader bar is bowed over its entire length so as to be convex with respect to the side on which the hook is located. This convex shape corresponds closely to the curvature of the human chest and provides for a comfortable fit.

A relatively simple and low-cost production is possible if the spreader bar is an injection molded plastic article. Preferably, the hook and the hook plate are made of metal (e.g. stainless steel).

The support device according to the invention is adapted, preferably, for placement onto the front of a person's upper torso by means of a transverse belt. Nevertheless, other applications are conceivable, such as belt assist means for mountain climbers, miners or firefighters for use in normal or in life-saving situations. For example, the support device according to the invention may also be attached to the back of a person, to be used, for instance, for a life-saving operation, or as support device for sky-divers.

Thus, the invention provides, by way of surprisingly simple means, a spreader bar for a flexible transverse belt which is applied to the upper torso of a person and is subjected to a centrally acting pulling force from the front or the back. The spreader bar, which extends longitudinally in accordance with the width of a person's chest, prevents the lateral forces of a pulled rope from being applied to the upper torso, so that the user of the support device is afforded increased comfort. Yet another advantageous feature is the reduced injury hazard to the user, especially when the hook is subjected to jerks (e.g. fall of mountain climber tied to the hook). The device is light in weight, easy to handle and provides maximum freedom of movement to the user. There is no need for current-type multi-belt systems any more, or for rigid large-area upholstered shells attached to the back or the chest of the user. With the hook connected to the rope, the spreader bar normally affords a comfortable fit as it is applied to the front of a person's chest, so that for all practical purposes lateral displacement of the spreader bar is not possible. The support device may be applied in one of two different positions, e.g. hook opening upward, hook opening downward. Manufacture is simple and economical. If the support device of the invention is used in combination with a Hawaii trapeze system, it becomes an ideal auxiliary gear, because in this type of application it will serve as aa trapeze brace in which the trapeze belt is being guided. The pull by the sail acting on the trapeze brace by way of the rope is transmitted, without causing any lateral pressure, to the back portion of the trapeze belt, which in most instances is upholstered.

Other objects and advantages of the present invention will become apparent to those skilled in the art when the following description of the best modes contemplated for practicing the invention is read in conjunction with the accompanying drawing wherein like numerals refer to like or equivalent parts and in which:

DETAILED DESCRIPTION OF THE PREFERRED EMBODIMENTS

Figure 1:
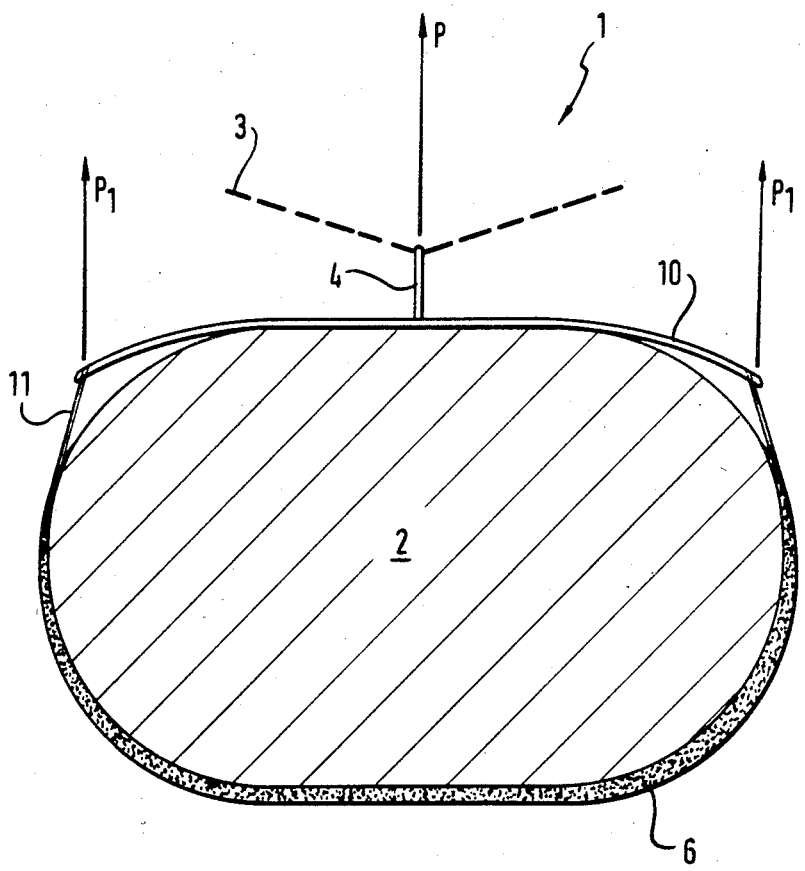
FIG. 1 is a schematic cross section of the support device according to the invention.
Figure 2:
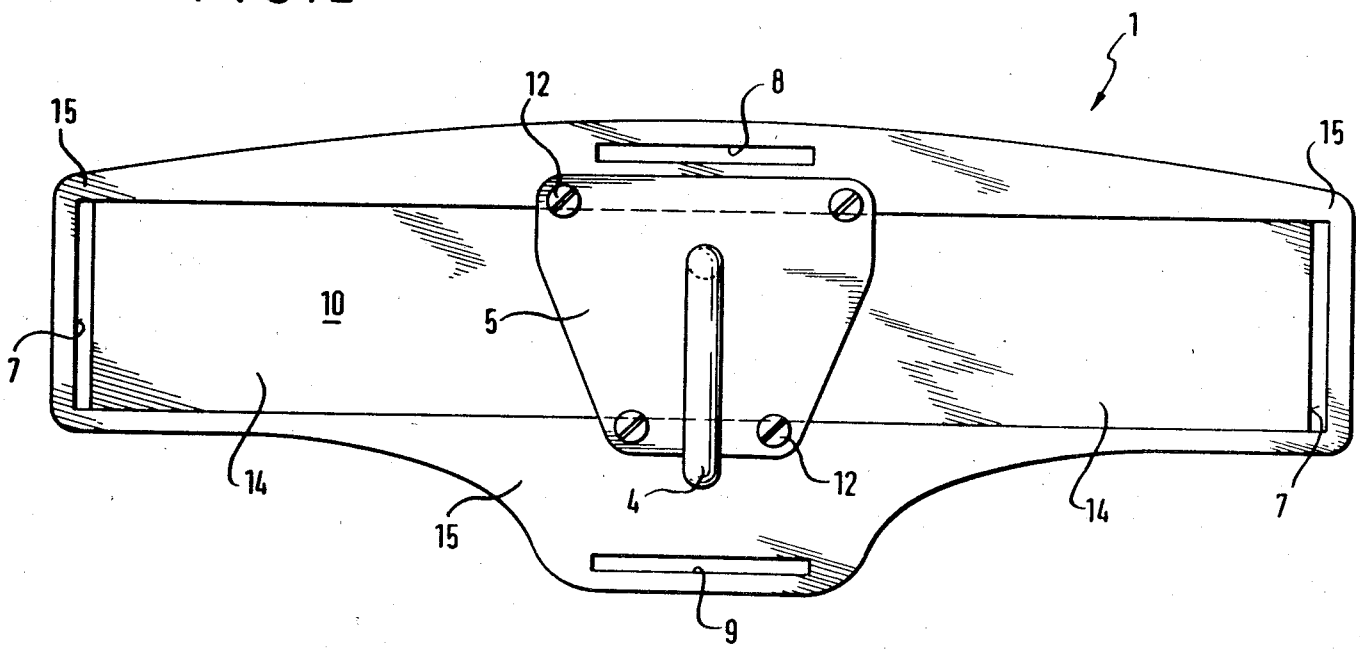
FIG. 2 is a front elevation view of the support device including a cross section of the hook thereof.

Referring to FIG. 1, reference numeral 2 denotes a section through the upper torso of a surfer wearing a support device 1 according to the invention. The support device 1, which is shown in greater detail in FIG. 2, is comprised of a flat metal hook plate 5, a hook 4 fastened to the hook plate 5, a lateral hook opening, and an elongate spreader bar 10 having a limited degree of flexibility. In the structure illustrated, the hook plate 5 is medially attached to the spreader bar 10 by way of recessed flat-head bolts 12 and recessed nuts, said spreader bar being made of plastics material by way of injection molding.

The hook plate 5 preferably has approximately 80 square mm of surface area. The thickness of the hook is about 8 mm, for example. The flat-head bolts 12, numbering four as shown, are of the M4format. The length of the spreader bar 10 corresponds approximately to the width of the chest of a surfer (e.g. 300 mm), and the width of the spreader bar 10 is approximately 110 mm.

A track 14 for guiding a transverse belt 11 is provided in the spreader bar 10 in the form of a longitudinal integral recess, thereby defining a raised marginal portion 15 as apparent from FIG. 2. The width of the track 14 corresponds approximately to that of an average belt (about 50 mm). At each end portion of the track 14, elongate apertures are provided in the spreader bar 10. The apertures form lateral slots 7 which permit feeding the transverse belt 11 positioned in the track 14 laterally through the spreader bar 10. The belt 11 extends to the back of the upper torso 2, as illustrated in FIG. 1. The back of the transverse belt 11 has an integral upholstered back portion 6 conforming to the contours of the back of a surfer. The width of the slots 7 is preferably about 4 mm.

In the area of the hook plate 5, an upper slot 8 and a lower slot 9, both corresponding in shape to the lateral slots 7, are formed in the raised marginal portion 15 of spreader bar 10. The upper slot 8 and lower slot 9 may be used to accommodate shoulder belts as well as a crotch belt, not shown.

The hook plate 5 is mounted by means of the bolts 12 on the raised marginal portion 15 such that, by virtue of the recessed track 14, a longitudinal passage is formed between the hook plate 5 and the spreader bar 10 to accommodate the belt 11 that is extending therethrough.

As illustrated at FIG. 1, the length of the spreader bar 10 corresponds approximately to the width of the chest of a surfer, and the shape of the spreader bar 10 is convex with respect to the side on which the hook 4 is located, so as to approximately conform to the curvature of a person's chest.

If, in the operation of a Hawaii trapeze spreader gear of the type illustrated in FIG. 1, a towing rope 3 of a trapeze type gear is retained in the hook 4 of a support device 1 being worn on the upper torso 2 of a person, the centrally acting force P of the rope when pulled is split into two parallel lateral forces $P_1$ of equal magnitude. For all practical purposes, the two lateral forces $P_1$ are evenly distributed along the length of the transverse belt 11 extending through the slots 7 in such a manner that the upper torso 2 is not subjected to lateral forces which may otherwise cause discomfort to the wearer.

Figure 3:
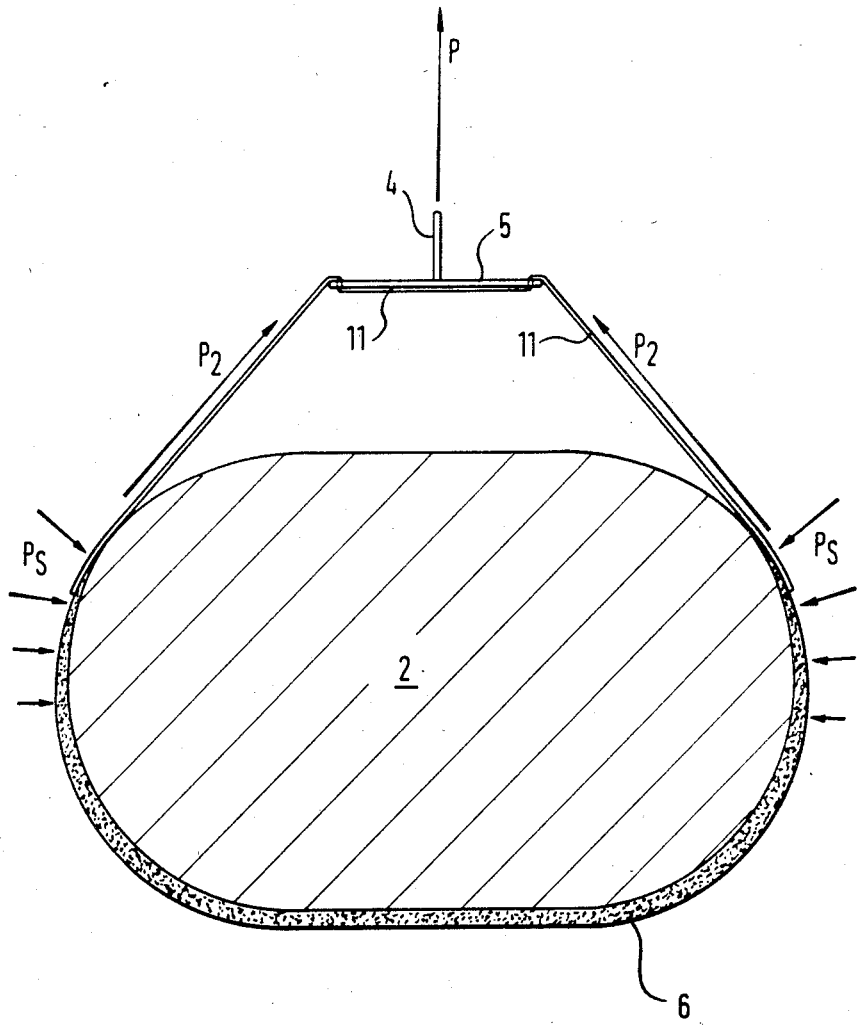
FIG. 3 is a sectional view similar to that of FIG. 1, but showing a state-of-the-art support device.

For the purpose of comparison, FIG. 3 shows a conventional support device with a square hook plate 5 of relative small dimensions as compared to the width of a human chest. When the conventional support device is used by a person, the hook plate 5 is positioned at a relatively great distance away from the chest of the person and thus is not controlled in longitudinal or transverse direction. The force exerted by the centrally positioned rope P is therefore angularly transmitted to the transverse belt 11 of the conventional support device, as shown at $P_2$, which transverse belt 11 in turn exerts lateral pressure $P_s$ to the upper torso 2 of a wearer causing lateral constriction of his chest.

Having thus described the invention by way of typical structural embodiments thereof, modification whereof will be apparent to those skilled in the art, what is claimed as new is as follows:

I claim:

1. In a Hawaii trapeze support device having a hook for suspending a person wearing the support device on a rope, wherein said person wearing said support device is suspended in a substantially horizontal position and is retained in said support device at the upper torso by means of a transverse belt wrapped around the upper torso of said person, the improvement comprising a substantially rigid spreader bar having an exterior side and means on said exterior side for attaching a portion of said belt across said exterior side of said spreader bar, said means for attaching said portion of said belt comprising a slot at each end of said spreader bar, wherein said portion of said belt is passed through each slot for securing said belt to said spreader bar, and a hook member for attachment to said rope connected to said spreader bar between the ends of said spreader bar and extending over said portion of said belt extending across said exterior side of said spreader bar, a pair of substantially parallel raised marginal portions each at an edge of said spreader bar and extending substantially the whole length of said spreader bar, said raised marginal portions confining therebetween the portion of said belt extending across the exterior side of said spreader bar, wherein the length of said spreader bar corresponds approximately to the width of a human chest for preventing lateral forces to the right and to the left of the chest of said person in said support device.

2. A support device according to claim 1 further comprising said hook member being integrally formed on a hook plate, said hook plate being attached to the spreader bar.

3. A support device according to claim 2, further comprising said hook plate detachably connected to said spreader bar by means of recessed flat-head bolts.

4. A support device according to claim 2, further comprising said hook plate fixedly attached to said spreader bar by means of recessed tubular rivets.

5. A support device according to claim 2 further comprising said hook and said hook plate being made of metal.

6. A support device according to claim 1 further comprising said spreader bar being provided midway between its ends with at least one lower additional slot for accommodating a second belt.

7. A support device according to claim 1 further comprising said spreader bar being provided midway between its ends with at least one set of upper and lower slots for accommodating a second belt.

8. A support device according to claim 1 further comprising said spreader bar being an injection-molded plastic article.

9. A support device according to claim 1 further comprising said spreader bar being provided midway between its ends with at least one upper additional slot for accommodating a second belt.

* * * * *

UNITED STATES PATENT AND TRADEMARK OFFICE

CERTIFICATE OF CORRECTION

PATENT NO. : 4,588,044

DATED : April 13, 1986

INVENTOR(S) : Clause Mader

It is certified that error appears in the above-identified patent and that said Letters Patent are hereby corrected as shown below:

Col. 3, line 12, change "aa" to --a--.

Col. 3, line 50, change "M4format" to --M4 format--.

Signed and Sealed this

Seventh Day of October, 1986

[SEAL]

*Attest:*

DONALD J. QUIGG

*Attesting Officer*

*Commissioner of Patents and Trademarks*